US009761979B2

(12) United States Patent
Shah et al.

(10) Patent No.: US 9,761,979 B2
(45) Date of Patent: Sep. 12, 2017

(54) LOW-PROFILE ELECTRICAL AND MECHANICAL CONNECTOR

(71) Applicant: Apple Inc., Cupertino, CA (US)

(72) Inventors: Dhaval N. Shah, Fremont, CA (US); Trevor J. Ness, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 285 days.

(21) Appl. No.: 14/446,163

(22) Filed: Jul. 29, 2014

(65) Prior Publication Data

US 2015/0092324 A1 Apr. 2, 2015

Related U.S. Application Data

(60) Provisional application No. 61/884,964, filed on Sep. 30, 2013.

(51) Int. Cl.

| | |
|---|---|
| ***H01R 13/24*** | (2006.01) |
| *H01R 12/71* | (2011.01) |
| *H01R 13/52* | (2006.01) |

(52) U.S. Cl.

CPC ..... *H01R 13/2407* (2013.01); *H01R 12/714* (2013.01); *H01R 13/2435* (2013.01); *H01R 13/521* (2013.01)

(58) Field of Classification Search

CPC H01R 13/2435; H01R 13/521; H01R 12/714; H01R 13/2407; H01R 12/718

USPC ..... 200/302.2

See application file for complete search history.

(56) References Cited

U.S. PATENT DOCUMENTS

| | | | | |
|---|---|---|---|---|
| 4,460,847 | A * | 7/1984 | Englehardt | H01T 13/41 313/136 |
| 5,551,069 | A | 8/1996 | Harrison et al. | |
| 6,295,033 | B1 | 9/2001 | Chatzipetros et al. | |
| 6,810,237 | B1 | 10/2004 | McEowen | |
| 6,829,198 | B1 * | 12/2004 | Janus | G01V 1/04 367/163 |
| 6,831,609 | B2 | 12/2004 | Shively et al. | |
| 6,897,827 | B2 | 5/2005 | Senba et al. | |
| 6,963,039 | B1 * | 11/2005 | Weng | H01H 23/06 200/302.1 |
| 7,025,597 | B1 * | 4/2006 | Chang | H01R 11/287 439/39 |
| 7,612,725 | B2 | 11/2009 | Hill et al. | |
| 7,642,974 | B2 | 1/2010 | Brady et al. | |
| 7,695,285 | B2 * | 4/2010 | Sugiura | H01R 13/2421 439/66 |
| 7,755,553 | B2 | 7/2010 | Packer et al. | |

(Continued)

*Primary Examiner* — David M Sinclair
*Assistant Examiner* — Robert Brown
(74) *Attorney, Agent, or Firm* — Michael H. Lyons; David K. Cole

(57) ABSTRACT

A connector providing both an electrical and mechanical connection and an electronic device utilizing the connector. The connector includes a rigid body, a head connected to the rigid body, and a flexible conductor coupled to the body. The rigid body and the flexible conductor define an electrically conductive path to the head. An electronic device includes a housing defining at least one sidewall, an interior component, and a connector passing through at least one sidewall and mechanically contacting the interior component. The connector defines an electrically conductive path from the interior component to an exterior of the housing.

21 Claims, 5 Drawing Sheets

(56) References Cited

U.S. PATENT DOCUMENTS 7,812,771 B2 10/2010 Greene et al.
7,815,474 B1 * 10/2010 Lin ..... H01R 13/2421 439/482
7,861,312 B2 12/2010 Lee et al.
7,911,387 B2 3/2011 Hill et al.
7,916,089 B2 3/2011 Schlub et al.
8,102,319 B2 1/2012 Schlub et al.
8,106,836 B2 1/2012 Hill et al.
8,138,977 B2 3/2012 Zhang et al.
8,193,998 B2 6/2012 Baliarda et al.
8,325,094 B2 12/2012 Ayala Vazquez et al.
8,350,761 B2 1/2013 Hill et al.
8,866,679 B2 10/2014 Golko et al.
8,951,054 B2 * 2/2015 Byrne ..... H01R 13/447 307/104
8,995,141 B1 * 3/2015 Rathi ..... H05K 3/32 248/229.22
9,161,434 B2 * 10/2015 Merz ..... C23C 16/042
9,171,535 B2 * 10/2015 Abe ..... G10K 11/002
9,182,378 B2 * 11/2015 Gogol, Jr. ..... G01N 29/12
2005/0048807 A1 * 3/2005 Li ..... H01L 21/486 439/66
2006/0166564 A1 * 7/2006 Baranowski ..... H01R 13/635 439/700
2006/0256510 A1 * 11/2006 Nakasono ..... G07C 9/00944 361/679.02
2007/0188391 A1 8/2007 Tu et al.
2008/0284305 A1 * 11/2008 Hoffman ..... H01T 13/34 313/141
2010/0045541 A1 2/2010 Aoki et al.
2011/0005908 A1 * 1/2011 Lin ..... H01H 13/063 200/302.2
2013/0264084 A1 * 10/2013 Beckman ..... B25B 23/00 173/2
2014/0206210 A1 * 7/2014 Ritner ..... H01R 12/79 439/84
2014/0213113 A1 * 7/2014 Chen ..... H01R 12/714 439/626
2014/0260621 A1 * 9/2014 Gogol, Jr. ..... G01N 29/12 73/579
2014/0377986 A1 * 12/2014 Endo ..... H01R 13/2421 439/519
2015/0255903 A1 * 9/2015 Fujii ..... H01R 12/714 439/889

* cited by examiner

LOW-PROFILE ELECTRICAL AND MECHANICAL CONNECTOR

CROSS-REFERENCE TO RELATED APPLICATION

This application is a nonprovisional patent application of and claims the benefit to U.S. Provisional Patent Application No. 61/884,964, filed Sep. 30, 2013 and titled "Low-Profile Electrical and Mechanical Connector," the disclosure of which is hereby incorporated herein by reference in its entirety.

TECHNICAL FIELD

Embodiments described herein relate generally to connectors, and more particularly to a connector providing both an electrical and mechanical connection.

BACKGROUND

Many connectors may provide either electrical or mechanical connections between two elements. For example, screws, bolts and nails may mechanically fasten one object to another, thereby providing a mechanical connection between the two. Likewise, solder, flex circuits, electrical traces and the like provide electrical connections between two elements.

Generally, however, different connectors are used to provide mechanical connections and electrical connections between two elements. Using multiple connectors of different types may require additional space to form the connections, and may be inefficient in terms of the component layout of electronic devices, especially small form factor electronic devices.

SUMMARY

One embodiment may take the form of a connector, including a rigid body, a head connected to the rigid body, and a flexible conductor coupled to the body. The rigid body and the flexible conductor define an electrically conductive path to the head.

Further, in some embodiments the rigid body defines an interior cavity, and the flexible conductor is at least partially received within the interior cavity. The flexible conductor is also affixed to the rigid body within the interior cavity.

Another embodiment may take the form of an electronic device, including a housing defining at least one sidewall, an interior component, and a connector passing through the at least one sidewall and mechanically contacting the interior component. The connector defines an electrically conductive path from the interior component to an exterior of the housing.

In some embodiments, the connector includes a head, a body affixed to the head, and a flexible connector affixed to the body. The head is positioned in the exterior of the housing, the body passes through the at least one sidewall, and the flexible connector mechanically contacts the interior component.

These and other embodiments will become clear upon reading the specification in its entirety.

BRIEF DESCRIPTION OF THE FIGURES

The Disclosure Will be Readily Understood by the Following Detailed Description in Conjunction with the Accompanying Drawings, Wherein Like Reference Numerals Designate Like Structural Elements, and in which.

Figure 1:
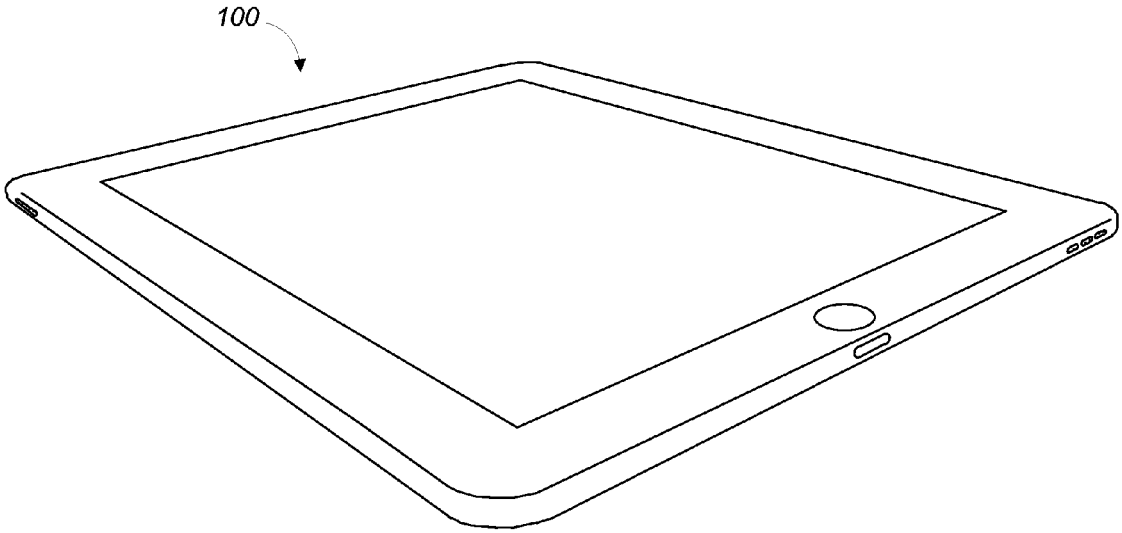
FIG. 1 depicts a perspective view of a sample electronic device.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

Embodiments discussed herein may take the form of a connector providing both mechanical fastening capabilities and an electrical path between two separate elements. The sample connector may have a rigid body defining an aperture and a compressible contact that may be at least partially housed within the body. The compressible contact may extend at least partially outside the body when the contact is in an uncompressed state.

In other embodiments, the compressible contact may be joined to the body at an end of the body, such that it is not contained even partially within the body. In still other embodiments, the compressible contact may at least partially surround an end or other segment of the body.

The compressible contact may provide an electrical path from its tip or terminus through the body, or may form an electrical path in conjunction with the body. That is, the body itself may be partially or fully electrically conductive in certain embodiments. Alternately in some embodiments the body may be an electrical insulator.

In still other embodiments, a portion of the body may be formed from an insulator while the rest of the body is electrically conductive. Alternatively, an insulator may be added, affixed, adhered or placed adjacent to part of the body instead of forming a part of the body from the insulator.

The insulator and/or body may also provide a water-tight seal in some embodiments.

FIG. 1 shows a sample electronic device 100 that may incorporate one or more low-profile electrical and mechanical connectors, as described herein. The electronic device may be any of a number of suitable devices including, but not limited to, a mobile phone, a tablet computing device, a wearable device, a portable computer, a desktop computer, an appliance, a touch screen, a media player, and so on. Many embodiments of the electronic device may be relatively small and portable, especially as internal space may be at a premium in such devices.

Figure 2:
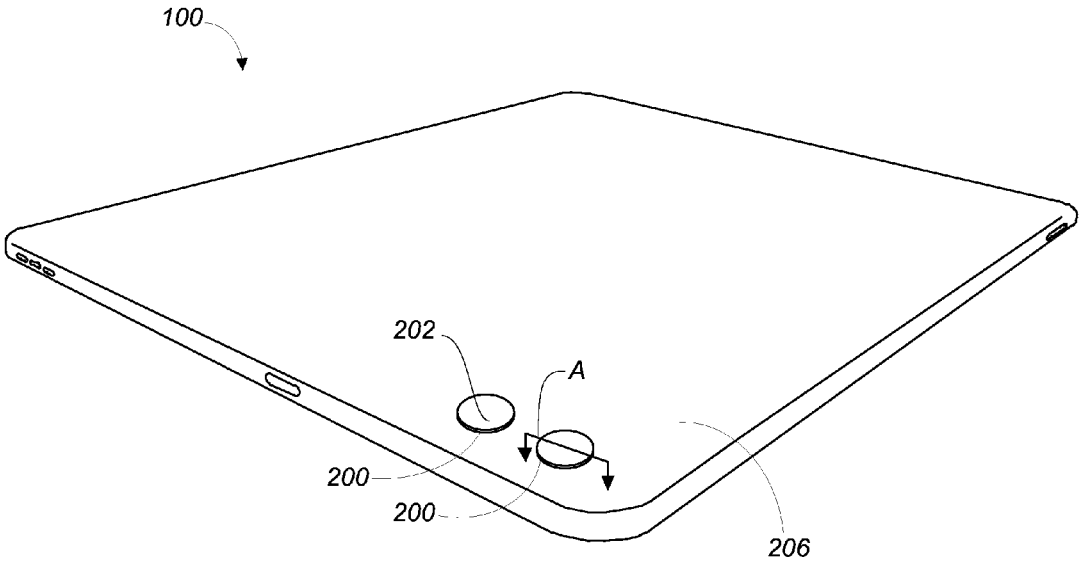
FIG. 2 depicts a bottom view of the sample electronic device of FIG. 1.

FIG. 2 depicts a bottom view of the sample device of FIG. 1. As shown in FIG. 2, one or more electrical/mechanical connectors 200 may extend through a sidewall 206 of the device 100. A head or upper portion 202 of the connector 200 may be externally visible and accessible (e.g., able to be viewed and accessed from outside the device 100). In this manner and presuming the head 202 of the connector 200 is electrically conductive, an electrical connection may be made through the dual-purpose electrical/mechanical connector 200 between an internal electrical element, component or the like and an electrical component located outside the device.

As one non-limiting example, the connector 200 may provide an electrical path to charge a battery housed within the electronic device 100. For example, the head 202 of the connector 200 may come in contact with a charging pad or station and transmit power through the connector to the internal battery. The electrical connection to charge the battery or other component within the electronic device may be a direct contact or an inductive path through the connector.

As another example, the connector 200 may be used in lieu of a data port, such as a universal serial bus port, LIGHTNING port, HDMI port, or other data port. A cable may be fitted to or be touched to the segment of the connector 200 that protrudes from or that is flush with the housing of the electronic device 100 in order to transmit data from the cable, through the connector 200 and to a component housed within the device. The head 202 of the connector 200 may protrude from the housing and/or be specially shaped to accept a cable, in some embodiments.

In some embodiments, the electrical/mechanical connector 200 may provide an electrical path or connection between an interior electrical component and an environment exterior to the electronic device 100. For example, the connector 200 may serve as an antenna, connecting a transmitter or transceiver integrated circuit with the environment outside the device 100 and thereby providing a signal path for the transmitter or transceiver.

Figure 3:
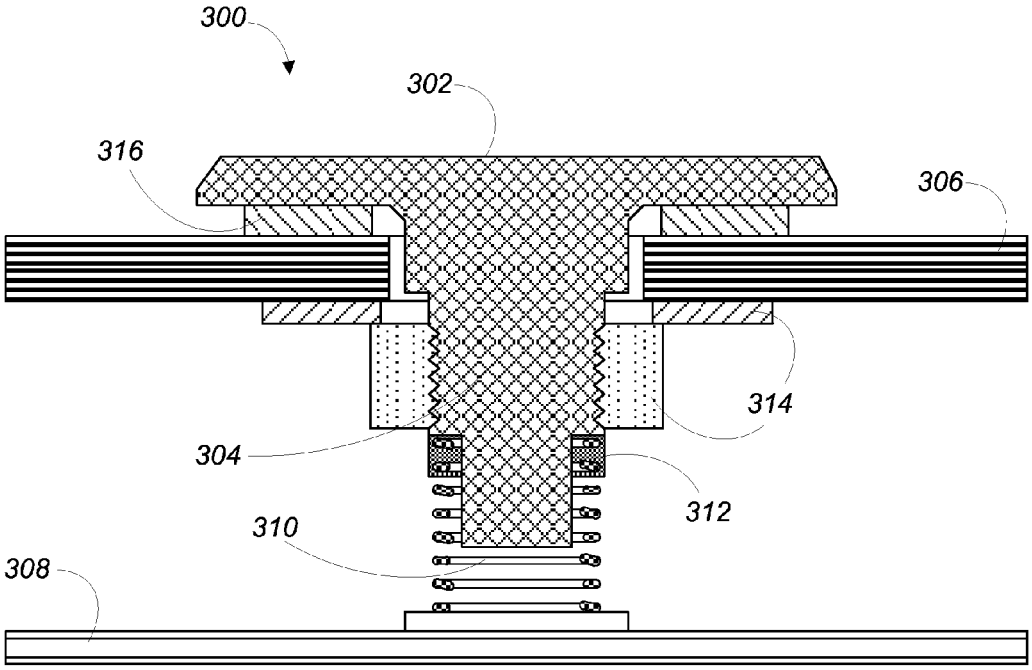
FIG. 3 depicts a cross-sectional view taken along line A-A of FIG. 2, showing a first sample electrical and mechanical connector.

FIG. 3 is a cross-sectional view taken along line A-A of FIG. 2, showing a first sample low-profile electrical and mechanical connector 300. The connector 300 is one example embodiment of the generalized connector 200 previously discussed.

As shown in FIG. 3, the connector 300 may include a head 302 that is external to the electronic device 100 and a body 304 extending through a sidewall 306 of the device 100. The body 304 may be threaded or otherwise machined along a portion of its exterior, as shown in the figure, and may be rigid. Such threading may facilitate holding the connector 300 in place within the sidewall 306. In some embodiments, the threading or machining may also facilitate forming or maintaining a mechanical connection between the sidewall and an interior component 308 within the device 100. For example, the threaded portion of the body 304 may pass through both the sidewall 306 and interior component 308, and may mechanically secure one to the other. Generally, the head 302 and body 304 of the connector 300 are electrically conductive to serve as an electrical path.

A spring 310 may be affixed to the body 304 of the connector 300 and may extend beyond an end of the body 304. The spring 310 and body 304 may be affixed with a joinder 312, for example a solder or any other suitable joinder or adhesive. Typically, the spring 310 is electrically conductive. In certain embodiments, the joinder 312 may be electrically conductive in order to maintain an electrical path from the spring 310, through the body 304 and to the head 302 of the connector 300. In other embodiments, the joinder 312 may not be electrically conductive, and the spring 310 may make physical contact with the body 304 to create an electrical connection. Some embodiments may use a flexible conductor, such as a wire, coil, S-shaped metal piece, leaf, other form of spring or the like in lieu of the depicted spring 310.

The spring 310 may contact the interior component 308, thereby establishing an electrically conductive path between the head 302 of the connector 300 and the interior component 308. Further, the spring may compress against the interior electrical component 308 as the threaded body 304 is turned through the sidewall 306, thus ensuring a snug connection and, optionally, a mechanical connection through friction. Accordingly, the connector 300 may maintain the relative positions of the housing (or at least sidewall) and interior component 308. It should be appreciated that the interior component 308 may have both mechanical and electrical properties or segments. For example, the interior component 308 may not only include an electrical connection to the connector 300, but may also provide structure or support to the electronic device 300 or components within the device.

The spring 310 may also optionally mechanically connect the connector 300 to the internal component 308. For example, the spring 310 may dig into the electrical component as it is turned against the component's surface, presuming the component 308 is sufficiently soft and the spring sufficiently firm. Alternately, a channel may be defined within the electrical component to accept the end of the spring 310 as it rotates when the connector 300 is turned to push the body 304 through the sidewall 306.

It may be useful to electrically isolate the connector 300 from the sidewall 306. The sides of the through-hole defined in the sidewall 306 (e.g., the hole through which the connector 300 passes) may be coated with an insulator in some embodiments. Likewise, any portion of the sidewall 306 underlying the head 302 may be coated with an insulator. Alternately, a nut and washer 314 may be placed within the interior of the device and the body 304 threaded through the nut and washer. The washer and/or nut 314 may be plastic or another insulating material and may serve to hold the connector 300 in place when the sidewall 306 is frictionally engaged with both the washer (or nut) and bottom of the head 302. The nut 314 may be a portion of a second internal element, such as a plate, body or other mechanical structure, a portion of another electrical component, such as a flex cable or the like, or may be connected to a second internal element such as the aforementioned mechanical structure or electrical component. Thus, the connector 300 may mechanically join the housing not only to the internal component 308 but also to another internal structure or element.

In some embodiments, the underside of the head 302 may be treated with an electrically insulating material 316, or may compress such a material against the sidewall 306. The electrically insulating material 316 may also form a watertight seal, thus preventing ingress of liquid, moisture, debris and the like into the interior of the electronic device. The electrically insulating material 316 may also prevent the connector 300 from forming an electrically conductive path with or to the sidewall 306.

Figure 4:
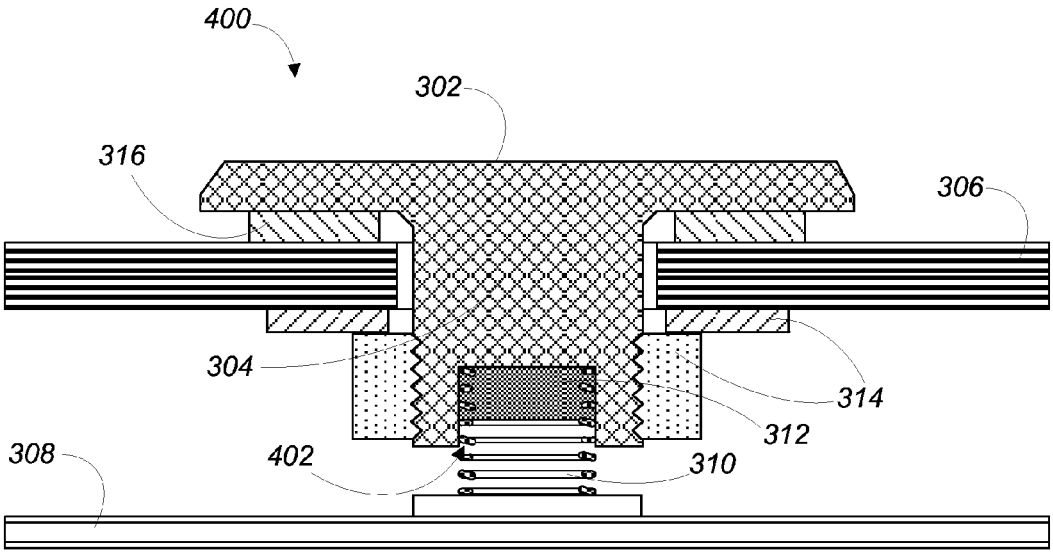
FIG. 4 depicts a cross-sectional view taken along line A-A of FIG. 2, showing a second sample electrical and mechanical connector.

FIG. 4 depicts a second embodiment of a dual-purpose electrical and mechanical connector 400. Here, the head 302, body 304, nut 314, insulator 316, sidewall 306 and electrical component 308 are generally the same, or function in a generally similar manner, to that described with respect to FIG. 3. The body, however, may have a cavity 402 formed within it. The spring 310 may be at least partially received within the cavity 402 instead of extending around the body 304. A portion of the spring 310 may extend downwardly from the body 304 and outwardly from the cavity 402 in order to contact the electrical component 308 and compress against the component as the connector 400 is pushed or turned through the sidewall 306. Solder or another joining material may connect the spring 310 to the body 304, again providing an electrical connection between the internal electrical component 308 and the head 302. An external electrical device or component may be connected to the head 302 to electrically communicate with the internal component 308, for example to provide power or charging thereto.

Figure 5:
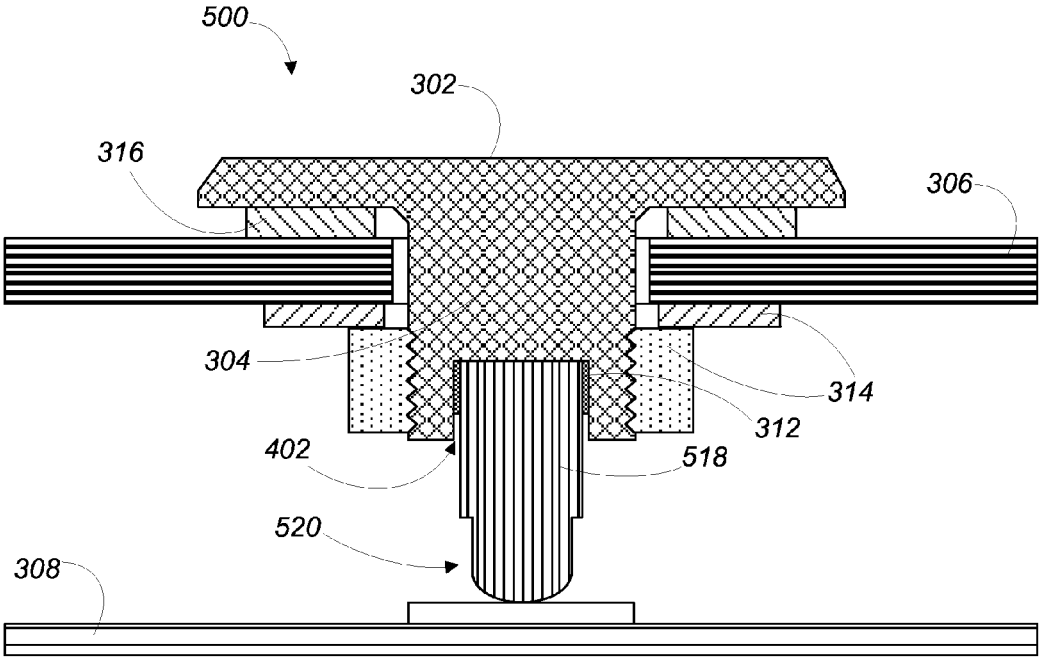
FIG. 5 depicts a cross-sectional view taken along line A-A of FIG. 2, showing a third sample electrical and mechanical connector.

FIG. 5 illustrates yet another sample electrical and mechanical connector 500. As with the embodiment shown in FIG. 4, the head 302, body 304, sidewall 306, electrical component 308, nut and washer 314 and insulator 316 may all function similarly to, or be the same as, those elements as described with respect to FIG. 3. In the embodiment of FIG. 5, however, a cavity 402 is defined within the connector body 304. The cavity 402 is similar to the same cavity shown in FIG. 4, however, at least a portion of the connector 500 may include a compressible pin 518, such as a pogo pin. A second portion 520 of the compressible pin 518 may extend from the cavity 402 downwardly to contact the internal electrical component 308. As with the spring 310 of prior embodiments (see, FIG. 3), the compressible pin 518 may be electrically conductive and may, in cooperation with the body 304, define an electrical path from the internal electrical component 308 to the head 302 of the connector 500.

The second portion 520 of the compressible pin 518 may be spring, biased to extend outward a certain distance from the body of the pin 518 and the cavity 402. As the connector 500 is pushed or turned against the component 308, the second portion 520 may compress into a body of the pin 518. Thus, the compressible pin 518 may provide not only an electrical connection between the connector 500 and the internal electrical component, but may also frictionally engage the component while the body 304 of the connector 500 mechanically engages the nut 314 affixed to the sidewall 306 (or, in some embodiments, mechanically engages the sidewall itself).

Thus, embodiments described herein may mechanically affix to an object while also providing an electrical path for an element within that object to an exterior of the object. Likewise, embodiments may provide both mechanical and electrical connections with an interior object located inside a housing.

Although certain embodiments have been described in detail, it should be appreciated that variations and changes may be made to such embodiments without departing from the spirit and scope of coverage herein.

We claim:

1. A connector, comprising:

a rigid body comprising a threaded portion;

a head connected to the rigid body; and a flexible conductor coupled to the rigid body, wherein the threaded portion is interposed between the head and the flexible conductor, the rigid body includes an interior cavity, the flexible conductor is at least partially received within the interior cavity, the flexible conductor is affixed to the rigid body within the interior cavity, and the rigid body, the head, and the flexible conductor form an electrically conductive path.

2. The connector of claim 1, further comprising an electrical insulator positioned on a surface of the head.

3. The connector of claim 2, wherein:

the connector is configured for insertion through a structure; and the electrical insulator forms a water-tight seal between the head and the structure.

4. The connector of claim 3, wherein the electrical insulator electrically insulates the connector and the structure.

5. The connector of claim 1, wherein the flexible conductor is affixed to the rigid body.

6. The connector of claim 1, wherein the flexible conductor is configured to compress in response to movement of the rigid body.

7. The connector of claim 1, wherein the flexible conductor comprises a spring.

8. The connector of claim 1, wherein the flexible conductor comprises a compressible pin.

9. An electronic device configured to receive power from an external charging system, the electronic device comprising:

a housing having a conductive wall with opposing internal and external surfaces;

a conductive structure comprising:

a rigid portion passing through the conductive wall, and a head attached to an end of the rigid portion;

insulating material interposed between the head of the conductive structure and the external surface of the conductive wall; and a battery, wherein the conductive structure is configured to convey the power from the external charging system to the battery.

10. The electronic device of claim 9, wherein the conductive structure mechanically couples the battery and the conductive wall.

11. The electronic device of claim 9, wherein the rigid portion comprises a body affixed to the head, the body passing through the conductive wall.

12. The electronic device of claim 9, wherein a flexible component is affixed to the rigid portion using an electrically conductive material.

13. The electronic device of claim 9, wherein:

the electronic device further comprises a securing component positioned within the housing; and the securing component mechanically couples the housing and the battery.

14. The electronic device of claim 9, wherein the conductive structure is configured to maintain an offset between the internal surface of the conductive wall and the battery.

15. A connector, comprising:

a rigid component configured to engage with a wall of an electronic device, wherein the rigid component comprises a head that forms a first end of the rigid component, the rigid component comprises a threaded portion that forms a second end of the rigid component, and the second end opposes the first end; and a spring coupled to the second end of the rigid component, wherein the threaded portion is interposed between the head and the spring, the spring is configured to exert a compression force on an internal component of the electronic device, the spring is configured to maintain a gap between the internal component and the wall of the electronic device, and an electrically conductive path is defined between a top surface of the rigid component and the internal component.

16. The connector of claim 15, wherein:

the flexible component is configured to exert a compression force on the internal component in response to a movement of the rigid component along a direction toward the internal component.

17. The connector of claim 15, wherein the compression force impedes lateral movement of the flexible component relative to the internal component.

18. The connector of claim 15, wherein:

the top surface of the rigid component is configured for coupling with a charging system; and a battery of the electronic device is configured to receive a charge from the charging system via the connector.

19. The connector of claim 15, wherein the top surface of the rigid component is separated from the wall by an electrical insulator.

20. The connector of claim 19, wherein the electrical insulator forms a watertight seal between the top surface of the rigid component and the wall.

21. The connector of claim 15, wherein:

the connector further comprises a fastener positioned on the wall; and the rigid component extends through the wall to couple with the fastener, thereby retaining the rigid component within the wall.

* * * * *